US010483633B2

(12) United States Patent
Wu et al.

(10) Patent No.: US 10,483,633 B2
(45) Date of Patent: Nov. 19, 2019

(54) MULTIFUNCTIONAL GNSS ANTENNA

(71) Applicant: Harxon Corporation, Shenzhen, Guangdong (CN)

(72) Inventors: Wenping Wu, Guangdong (CN); Xiaohui Wang, Guangdong (CN); Shiwei Wu, Guangdong (CN); Jie Zhang, Guangdong (CN)

(73) Assignee: Harxon Corporation, Shenzhen, Guangdong (CN)

( * ) Notice: Subject to any disclaimer, the term of this patent is extended or adjusted under 35 U.S.C. 154(b) by 0 days.

(21) Appl. No.: 16/070,982

(22) PCT Filed: Oct. 11, 2017

(86) PCT No.: PCT/CN2017/105615

§ 371 (c)(1),
(2) Date: Jul. 18, 2018

(87) PCT Pub. No.: WO2019/028996

PCT Pub. Date: Feb. 14, 2019

(65) Prior Publication Data

US 2019/0173165 A1 Jun. 6, 2019

(30) Foreign Application Priority Data

Aug. 8, 2017 (CN) ..... 2017 2 0983178 U

(51) Int. Cl.
*H01Q 1/52* (2006.01)
*H01Q 1/38* (2006.01)
(Continued)

(52) U.S. Cl.
CPC ..... *H01Q 1/38* (2013.01); *H01Q 1/2291* (2013.01); *H01Q 1/50* (2013.01); *H01Q 1/52* (2013.01);
(Continued)

(58) Field of Classification Search
CPC .. H01Q 1/38; H01Q 1/50; H01Q 1/52; H01Q 1/2291; H01Q 9/0414; H01Q 21/28; H01Q 25/00
See application file for complete search history.

(56) References Cited

U.S. PATENT DOCUMENTS

2013/0342409 A1* 12/2013 Tatarnikov ..... H01Q 21/28 343/729
2016/0261047 A1* 9/2016 Wallace ..... H01Q 5/335
2017/0093042 A1* 3/2017 McMichael ..... H01Q 9/0428

OTHER PUBLICATIONS

International Search Report dated Mar. 19, 2018 for corresponding International Application No. PCT/CN2017/105615, filed Oct. 11, 2017.

(Continued)

*Primary Examiner* — Hoang V Nguyen
(74) *Attorney, Agent, or Firm* — David D. Brush; Westman, Champlin & Koehler, P.A.

(57) ABSTRACT

A multifunctional GNSS antenna includes a PCB and first and second dielectric plates arranged in a stacked manner. The PCB has a lower surface with a circuit network, which is covered by a metal shield cover. The first dielectric plate has an upper surface with a first metal layer and a lower surface attached to an upper surface of the PCB. A first feed probe penetrates the first metal layer and the first dielectric plate and is coupled with the circuit network. A third metal layer is embedded in an edge and a lateral surface of the first dielectric plate, and is coupled by a third feed probe with the circuit network while a first short-circuit probe shorts the third metal layer to ground. The second dielectric plate has an upper surface with a second metal layer coupled by a second feed probe with the circuit network.

7 Claims, 3 Drawing Sheets

(51) Int. Cl.

| | |
|---|---|
| ***H01Q 1/50*** | (2006.01) |
| ***H01Q 1/22*** | (2006.01) |
| ***H01Q 9/04*** | (2006.01) |
| ***H01Q 21/28*** | (2006.01) |
| ***H01Q 25/00*** | (2006.01) |

(52) U.S. Cl.
CPC ..... *H01Q 9/0414* (2013.01); *H01Q 21/28* (2013.01); *H01Q 25/00* (2013.01)

(56) References Cited

OTHER PUBLICATIONS

Written Opinion of the International Searching Authority dated Mar. 19, 2018 for corresponding International Application No. PCT/CN2017/105615, filed Oct. 11, 2017.

* cited by examiner

MULTIFUNCTIONAL GNSS ANTENNA

CROSS-REFERENCE TO RELATED APPLICATION

This application is a Section 371 National Stage Application of International Application No. PCT/CN2017/105615, filed Oct. 11, 2017, which claims priority to Chinese Patent Application No. 201720983178.1, filed with the Patent Office of PRC on Aug. 8, 2017, and titled "Multifunctional GNSS Antenna", the entire contents of which are incorporated herein by reference.

FIELD

The present disclosure relates to a technical field of satellite navigation antennas, and particularly, to a multifunctional GNSS antenna.

BACKGROUND

With the development of the IoT (Internet of Things) technology, GNSS navigation and high-precision positioning devices are becoming more and more multifunctional—having functions, such as Bluetooth, Wi-Fi, and 4G mobile communication, while implementing navigation and positioning. A traditional design adopts an idea of separate designs for each antenna, and fails to consider the interference and coupling among the antennas, so that a GNSS signal is easily subjected to the interference, and the positioning accuracy is reduced.

In the related art, a separately designed antenna is generally directly integrated. For example, a 4G or Wi-Fi antenna is directly placed around a GNSS antenna, and when a signal of the GNSS antenna is disturbed, the positioning accuracy will be reduced, and even the satellite will be in a loss of lock status.

SUMMARY

I. Technical Problems to be Solved

The present disclosure aims to provide a multifunctional GNSS antenna, to address the problems that a satellite antenna is susceptible to interference and is difficult to integrate in the prior art.

II. Technical Solutions

In order to solve the above technical problems, the present disclosure provides a multifunctional GNSS antenna, including a PCB, a first dielectric plate, and a second dielectric plate arranged in a stacked manner.

The PCB has a lower surface provided with a circuit network, and the circuit network is covered by a metal shield cover. The first dielectric plate has an upper surface provided with a first metal layer and a lower surface attached to an upper surface of the PCB. A first feed probe penetrates the first metal layer and the first dielectric plate to couple the first metal layer with the circuit network. A third metal layer is embedded in an edge and a lateral surface of the first dielectric plate. A third feed probe and a first short-circuit probe both penetrate the third metal layer and the first dielectric plate, and the third feed probe couples the third metal layer with the circuit network while the first short-circuit probe shorts the third metal layer to the ground. The second dielectric plate has an upper surface provided with a second metal layer. A second feed probe couples the second metal layer with the circuit network after penetrating the second metal layer, the second dielectric plate, the first metal layer, and the first dielectric plate.

The circuit network includes a feed network, a filter circuit, and a low-noise amplifying circuit. The first feed probe and the second feed probe are coupled with the feed network, and the third feed probe is coupled with the filter circuit. The low-noise amplifying circuit is used to amplify an electrical signal received by the feed network.

Based on the above technical solution, the lateral surface of the first dielectric plate is further provided with a fourth metal layer, and the fourth metal layer is coupled to the filter circuit by a fourth feed probe and is shorted to the ground by a second short-circuit probe.

Based on the above technical solution, the lateral surface of the first dielectric plate is further provided with a fifth metal layer, and the fifth metal layer is coupled to the filter circuit by a fifth feed probe and is shorted to the ground by a third short-circuit probe.

Based on the above technical solution, the multifunctional GNSS antenna further includes a third dielectric plate. The third dielectric plate has a lower surface attached to the upper surface of the second dielectric plate, and an upper surface provided with a sixth metal layer. A sixth feed probe penetrates the sixth metal layer, the third dielectric plate, the second metal layer, the second dielectric plate, the first metal layer, and the first dielectric plate successively. The sixth metal layer is coupled to the feed network by the sixth feed probe and is shorted to the ground by a fourth short-circuit probe.

Based on the above technical solution, two third metal layers and two third feed probes are provided, and the two third metal layers are arranged around the lateral surface of the first dielectric plate.

Based on the above technical solution, three third metal layers and three third feed probes are provided, and the three third metal layers are arranged around the lateral surface of the first dielectric plate.

III. Beneficial Effects

The multifunctional GNSS antenna according to the present disclosure realizes a multifunctional integrated design by utilizing the space around the original antenna, thereby saving space, avoiding interference and coupling among different antennas, reducing their mutual influence, and improving communication stability and reliability. In addition, the interference with the signal of the GNSS antenna is reduced by an external filter circuit for Bluetooth, Wi-Fi, and 4G antennas.

REFERENCE NUMERALS

Figure 1:
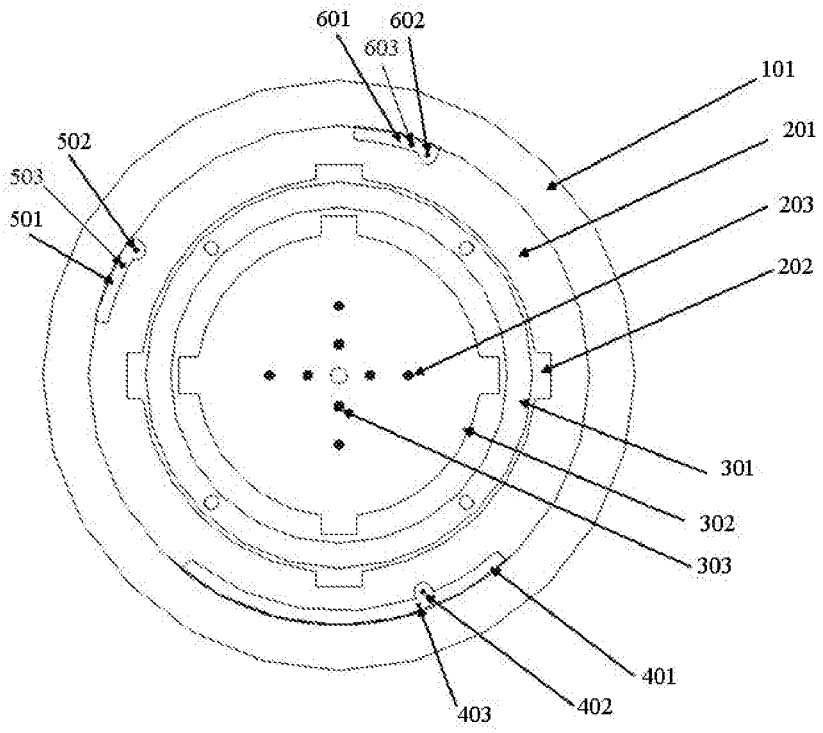
FIG. 1 is a first schematic view of a GNSS antenna structure according to an embodiment of the present disclosure.

101 PCB, 102 metal shield cover, 201 first dielectric plate, 202 first metal layer, 203 first feed probe, 301 second dielectric plate, 302 second metal layer, 303 second feed probe, 401 third metal layer, 402 third feed probe, 403 first short-circuit probe, 501 fourth metal layer, 502 fourth feed probe, 503 second short-circuit probe, 601 fifth metal layer, 602 fifth feed probe, 603 third short-circuit probe, 701 third dielectric plate, 702 sixth metal layer, 703 fourth short-circuit probe, 704 sixth feed probe.

DETAILED DESCRIPTION

Specific implementations of the present disclosure will be further elaborated with reference to accompanying drawings and embodiments. The following examples are used to understand the present disclosure rather than limit the scope of the present disclosure.

In the description of the present disclosure, it should be noted that "a plurality of" means two or more than two, unless specified otherwise: terms such as "upper," "lower," "left," "right," "inner," "outer," "front end," "rear end," "head," and "tail" are construed to refer to the orientation or position as then described or as shown in the drawings under discussion. These terms are only for convenience and simplicity of the description, and do not indicate or imply that the devices or elements referred to must have a particular orientation or be constructed or operated in a particular orientation. Thus, the terms are not constructed to limit the present disclosure. In addition, terms such as "first," "second," and "third" are merely used herein for purposes of description and are not intended to indicate or imply relative importance or significance.

In the description of the present disclosure, it should be further understood that, unless specified or limited otherwise, terms "mounted," "connected," and "coupled" and variations thereof are used broadly, and may be, for example, fixed connections, detachable connections, or integral connections: may also be mechanical or electrical connections: may also be direct connections or indirect connections via intervening structures, which can be understood by those skilled in the art according to specific situations.

Figure 2:
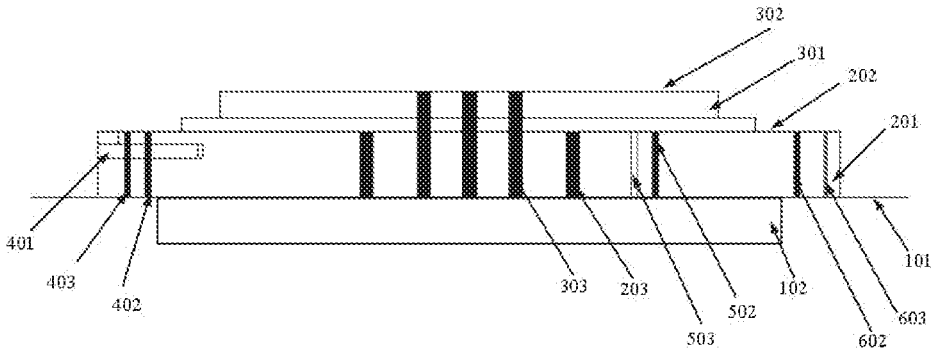
FIG. 2 is a side view of the GNSS antenna structure in FIG. 1.
Figure 3:
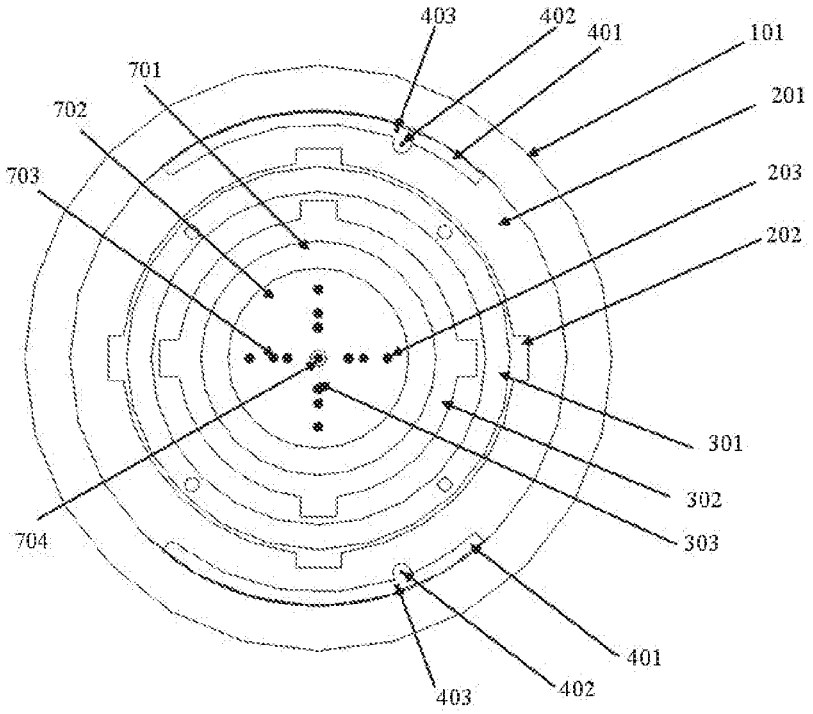
FIG. 3 is a second schematic view of a GNSS antenna structure according to an embodiment of the present disclosure.
Figure 4:
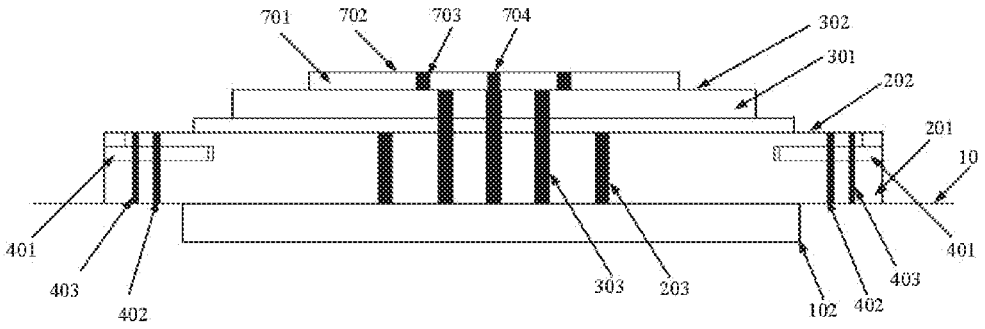
FIG. 4 is a side view of the GNSS antenna structure in FIG. 2.
Figure 5:
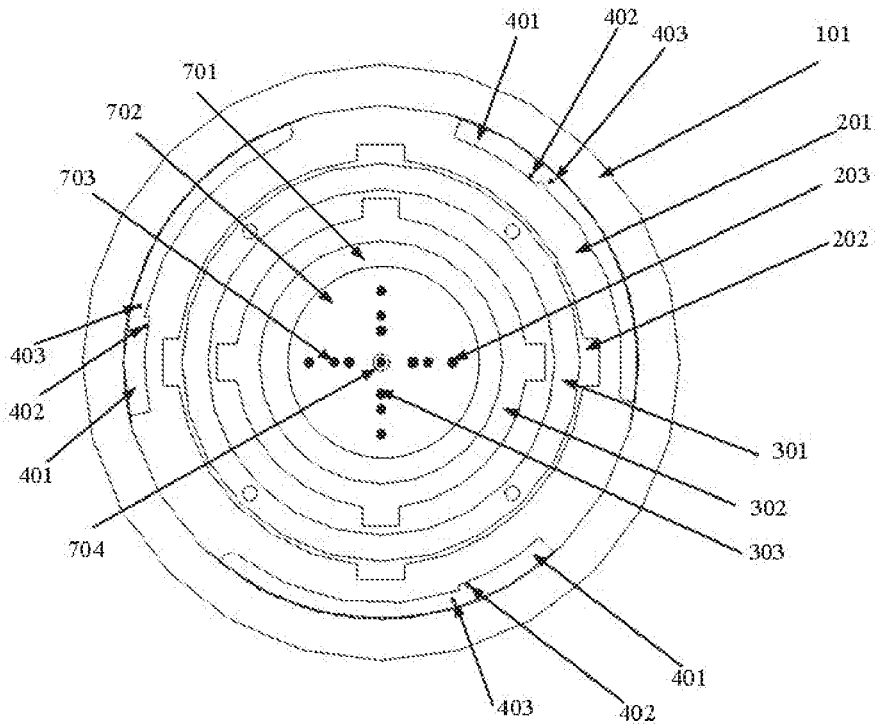
FIG. 5 is a third schematic view of a GNSS antenna structure according to an embodiment of the present disclosure.
Figure 6:
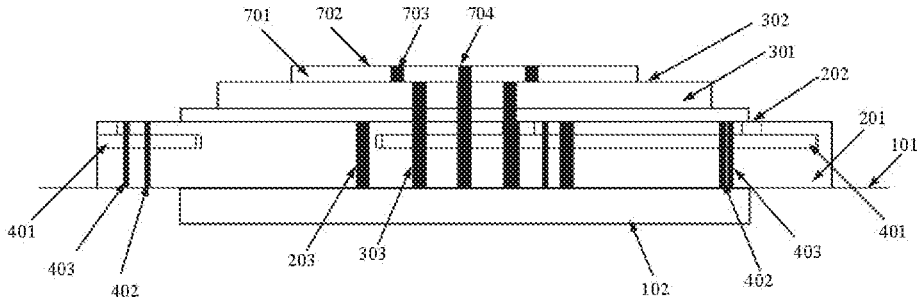
FIG. 6 is a side view of the GNSS antenna structure in FIG. 5.

FIG. 1 is a first schematic view of a GNSS antenna structure according to an embodiment of the present disclosure. FIG. 2 is a side view of the GNSS antenna structure in FIG. 1. FIG. 3 is a second schematic view of a GNSS antenna structure according to an embodiment of the present disclosure. FIG. 4 is a side view of the GNSS antenna structure in FIG. 2. FIG. 5 is a third schematic view of a GNSS antenna structure according to an embodiment of the present disclosure. FIG. 6 is a side view of the GNSS antenna structure in FIG. 5.

A multifunctional GNSS (Global Navigation Satellite System) antenna according to an embodiment of the present disclosure includes a printed circuit board (PCB) 101, a first dielectric plate 201, and a second dielectric plate 301 arranged in a stacked manner, as illustrated in FIGS. 1 and 2.

A lower surface of the PCB 101 is provided with a circuit network, and the circuit network includes a feed network, a filter circuit, and a low-noise amplifying circuit. The filter circuit is used to filter a Wi-Fi signal, a Bluetooth signal, a 4G signal or the like, while the low-noise amplifying circuit is used to amplify an electrical signal received by the feed network. The circuit network is covered by a metal shield cover 102. An upper surface of the PCB 101 is provided with the first dielectric plate 201, and an upper surface of the first dielectric plate 201 is provided with a first metal layer 202 of a relatively small thickness. A lower surface of the first dielectric plate 201 is attached to the upper surface of the PCB 101. A first feed probe 203 penetrates the first metal layer 202 and the first dielectric plate 201, to couple the first metal layer 202 with the feed network on the PCB 101. A third metal layer 401 is embedded in an edge and a lateral surface of the first dielectric plate 201. A third feed probe 402 and a first short-circuit probe 403 both penetrate the third metal layer 401 and the first dielectric plate 201. The third feed probe 402 couples the third metal layer 401 with the filter circuit, and the first short-circuit probe 403 shorts the third metal layer 401 to the ground. An upper surface of the second dielectric plate 301 is provided with a second metal layer 302, and a second feed probe 303 couples the second metal layer 302 to the feed network on the PCB 101 after penetrating the second metal layer 302, the second dielectric plate 301, the first metal layer 202, and the first dielectric plate 201.

By means of the design in this embodiment, the first dielectric plate 201, the first metal layer 202 and the first feed probe 203 are coupled with the PCB 101; the second dielectric plate 301, the second metal layer 302 and the second feed probe 303 are coupled with the PCB 101: a satellite positioning function can be realized after combination thereof. By providing the third metal layer 401, the third feed probe 402 and the first short-circuit probe 403, and coupling them with the filter circuit of the PCB 101, the Wi-Fi signal, the Bluetooth signal, or the 4G signal can be received and transmitted, a filtering function can be realized, and mutual interference with a satellite positioning signal can be avoided, thereby achieving a multifunctional operation of the antenna.

The multifunctional GNSS antenna according to the present disclosure realizes a multifunctional integrated design by utilizing the space around the original antenna, thereby saving space, avoiding interference and coupling among different antennas, reducing their mutual influence, and improving communication stability and reliability. In addition, the interference with the signal of the GNSS antenna is reduced by means of an external filter circuit for Bluetooth, Wi-Fi, and 4G antennas.

A plurality of first feed probes 203 and a plurality of second feed probes 303 can be provided, and optionally, one, two or four first feed probes 203 can be provided, and one, two or four second feed probes 303 can be provided.

Optionally, the lateral surface of the first dielectric plate 201 is further provided with a fourth metal layer 501, and as illustrated in FIGS. 1 and 2, the fourth metal layer 501 is coupled to the filter circuit of the PCB 101 by a fourth feed probe 502, and is shorted to the ground by a second short-circuit probe 503, such that the Bluetooth signal can be received. For example, the fourth metal layer 501 and the fourth feed probe 502 implement reception and transmission of the Bluetooth signal, and the third metal layer 401 and the third feed probe 402 implement reception and transmission of the 4G signal. In such a way, the antenna can realize transmission and reception of the GNSS satellite positioning signal, the Bluetooth signal, and the 4G signal simultaneously.

Optionally, the lateral surface of the first dielectric plate 201 is further provided with a fifth metal layer 601, and as illustrated in FIGS. 1 and 2, the fifth metal layer 601 is coupled to the filter circuit by a fifth feed probe 602, and is shorted to the ground by a third short-circuit probe 603, such that the third metal layer 401 and the third feed probe 402 can implement reception and transmission of the 4G signal, the fourth metal layer 501 and the fourth feed probe 502 can implement reception and transmission of the Wi-Fi signal, and the fifth metal layer 601 and the fifth feed probe 602 can implement reception and transmission of the Bluetooth signal. In such a way, the antenna can realize transmission and reception of the satellite positioning signal, the Wi-Fi signal, the Bluetooth signal, and the 4G signal simultaneously, and become multifunctional.

A schematic view of the multifunctional GNSS antenna according to another embodiment of the present disclosure is illustrated as FIGS. 3 and 4. The multifunctional GNSS antenna includes the PCB 101, the first dielectric plate 201, and the second dielectric plate 301 arranged in the stacked manner as illustrated in FIGS. 1 and 2, in which the lower surface of the PCB 101 is provided with the feed network and the filter circuit, which are cover by the metal shield cover 102. Different from the above embodiment, the GNSS antenna according to this embodiment further includes a third dielectric plate 701. A lower surface of the third dielectric plate 701 is attached to the upper surface of the second dielectric plate 301, and an upper surface of the third dielectric plate 701 is provided with a sixth metal layer 702. A sixth feed probe 704 and a fourth short-circuit probe 703 both penetrate the sixth metal layer 702, the third dielectric plate 701, the second metal layer 302, the second dielectric plate 301, the first metal layer 202, and the first dielectric plate 201 successively. The sixth metal layer 702 is coupled to the feed network by the sixth feed probe 704, and is shorted to the ground by the fourth short-circuit probe 703. This solution provides an antenna design scheme for horizontal omnidirectional radiation.

Based on the above embodiment, two third metal layers 401 and two third feed probes 402 are provided, and as illustrated in FIGS. 3 and 4, the two third metal layers 401 are arranged around the lateral surface of the first dielectric plate 201, so that the antenna can receive and transmit signals other than satellite signals, and for example, receive or transmit the Wi-Fi signal, the Bluetooth signals and the like simultaneously.

Based on the above embodiment, three third metal layers 401 and three third feed probes 402 are provided, and as illustrated in FIGS. 5 and 6, the three third metal layers 401 are arranged around the lateral surface of the first dielectric plate 201, to increase the communication function of the antenna.

The foregoing description is merely related to preferred embodiments of the present disclosure and is not intended to limit the present disclosure. Any modifications, equivalent alternatives, and improvements made within the spirit and the principle of the present disclosure shall be included in the scope of the present disclosure.

INDUSTRIAL APPLICABILITY

The multifunctional GNSS antenna according to the present disclosure realizes the multifunctional integrated design by utilizing the space around the original antenna, thereby saving space, avoiding interference and coupling among different antennas, reducing their mutual influence, and improving the communication stability and reliability. In addition, the interference with the signal of the GNSS antenna is reduced by the external filter circuit for Bluetooth, Wi-Fi, and 4G antennas.

What is claimed is:

1. A multifunctional GNSS antenna, comprising: a PCB, a first dielectric plate, and a second dielectric plate arranged in a stacked manner, the PCB having a lower surface provided with a circuit network, the circuit network being covered by a metal shield cover; the first dielectric plate having an upper surface provided with a first metal layer and a lower surface attached to an upper surface of the PCB, a first feed probe penetrating the first metal layer and the first dielectric plate to couple the first metal layer with the circuit network; a third metal layer being embedded in an edge and a lateral surface of the first dielectric plate, a third feed probe and a first short-circuit probe both penetrating the third metal layer and the first dielectric plate, and the third feed probe coupling the third metal layer with the circuit network while the first short-circuit probe shorts the third metal layer to the ground; and the second dielectric plate having an upper surface provided with a second metal layer, a second feed probe coupling the second metal layer with the circuit network after penetrating the second metal layer, the second dielectric plate, the first metal layer, and the first dielectric plate.

2. The multifunctional GNSS antenna according to claim 1, wherein the circuit network comprises a feed network, a filter circuit, and a low-noise amplifying circuit, the first feed probe and the second feed probe are coupled with the feed network, and the third feed probe is coupled with the filter circuit; the low-noise amplifying circuit is used to amplify an electrical signal received by the feed network.

3. The multifunctional GNSS antenna according to claim 2, wherein the lateral surface of the first dielectric plate is further provided with a fourth metal layer, and the fourth metal layer is coupled to the filter circuit by a fourth feed probe and is shorted to the ground by a second short-circuit probe.

4. The multifunctional GNSS antenna according to claim 3, wherein the lateral surface of the first dielectric plate is further provided with a fifth metal layer, and the fifth metal layer is coupled to the filter circuit by a fifth feed probe and is shorted to the ground by a third short-circuit probe.

5. The multifunctional GNSS antenna according to claim 2, further comprising a third dielectric plate having a lower surface attached to the upper surface of the second dielectric plate, and an upper surface provided with a sixth metal layer, a sixth feed probe penetrating the sixth metal layer, the third dielectric plate, the second metal layer, the second dielectric plate, the first metal layer, and the first dielectric plate successively, and the sixth metal layer being coupled to the feed network by the sixth feed probe and being shorted to the ground by a fourth short-circuit probe.

6. The multifunctional GNSS antenna according to claim 5, wherein two third metal layers and two third feed probes are provided, and the two third metal layers are arranged around the lateral surface of the first dielectric plate.

7. The multifunctional GNSS antenna according to claim 5, wherein three third metal layers and three third feed probes are provided, and the three third metal layers are arranged around the lateral surface of the first dielectric plate.

* * * * *